United States Patent [19]

Askew et al.

[11] 4,450,087

[45] May 22, 1984

[54] VAPOR LOCK RESISTANT HYDRAULIC FLUIDS

[76] Inventors: Herbert F. Askew, 68 Foxcote, Kiln Ride, Wokingham, Berkshire, England; Colin J. Harrington, 19 St. Pauls Gate, Wokingham, Berkshire, England; Terry J. P. Bridgwater, 520 Reading Rd., Winnersh, Berkshire, England

[21] Appl. No.: 476,561

[22] Filed: Mar. 18, 1983

Related U.S. Application Data

[63] Continuation of Ser. No. 188,517, Sep. 18, 1980, abandoned, which is a continuation of Ser. No. 095,350, Nov. 19, 1979, abandoned, which is a continuation of Ser. No. 875,611, Feb. 6, 1978, , which is a continuation of Ser. No. 799,096, May 20, 1977, abandoned, which is a continuation of Ser. No. 717,207, Aug. 24, 1977, abandoned, which is a continuation of Ser. No. 549,096, Jul. 8, 1975, abandoned.

[30] Foreign Application Priority Data

Jul. 12, 1974 [GB] United Kingdom ..... 31036/74
Mar. 27, 1975 [GB] United Kingdom ..... 13113/75

[51] Int. Cl.[3] ..... C10M 1/26; C10M 1/54

[52] U.S. Cl. ..... 252/73; 252/49.6; 252/78.1; 252/78.3; 252/78.5

[58] Field of Search ..... 252/49.6, 78.1, 78.3, 252/78.5, 73

[56] References Cited

U.S. PATENT DOCUMENTS

| | | | |
|---|---|---|---|
| 2,996,451 | 8/1961 | Irish et al. | 252/49.6 |
| 3,080,412 | 3/1963 | Young | 260/462 R |
| 3,125,528 | 3/1964 | Kay et al. | 252/78.1 |
| 3,200,074 | 8/1965 | Knowles et al. | 252/49.6 |
| 3,711,411 | 1/1973 | Sawyer et al. | 252/78.1 |
| 3,903,006 | 9/1975 | Elliott et al. | 252/73 |

*Primary Examiner*—John E. Kittle
*Assistant Examiner*—Robert A. Wax

[57] ABSTRACT

A composition suitable for use as a hydraulic fluid comprises:

(a) a lubricating oil preferably in an amount of from 20 to 80% by weight;

(b) a minor amount of oil-soluble borate ester;

(c) an amine which prevents deposition of oil-insoluble hydrolysis products of the borate ester; and optionally (d) an oil soluble orthoester of the formula:

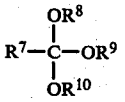

wherein $R^7$, $R^8$, $R^9$ and $R^{10}$ are specified groups.

7 Claims, No Drawings

VAPOR LOCK RESISTANT HYDRAULIC FLUIDS

This application is a continuation of application Ser. No. 188,517, filed Sept. 18, 1980, which is a continuation of Ser. No. 095,350 filed Nov. 19, 1979, which is a continuation of Ser. No. 875,611 filed Feb. 6, 1978, which is a continuation of Ser. No. 799,096 filed May 20, 1977, which is a continuation of Ser. No. 717,207 filed Aug. 24, 1977 which is a continuation of Ser. No. 549,096, July 8, 1975, all of these applications being now abandoned.

This invention relates to hydraulic fluids and particularly to mineral oil hydraulic fluids.

In hydraulic systems for which mineral oil or certain other fluids are specified as the operative fluid problems arise due to the presence of water. This water may be present as the result of condensation or inadequate drying prior to the filling of the system or subsequently, by diffusing through worn seals or flexible hoses. In either case the vapour lock temperature of the fluid can be reduced to the boiling point of water even by the presence of very minor amounts of water, e.g. of the order of 0.5%. This constitutes a serious deficiency with particularly dangerous consequences in those systems which are brake systems or central hydraulic systems including brake systems.

According to the present invention there is provided a composition suitable for use as a hydraulic fluid which comprises:

(a) a lubricating oil, preferably in an amount of from 20 to 80% by weight based on the total weight of the composition;

(b) a minor amount of oil-soluble borate ester, preferably of the general formula:

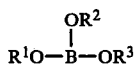

wherein:

(i) $R^1$, $R^2$ and $R^3$ are the same or different and each is an aryl group or a straight or branched chain alkyl group or alicyclic group, preferably containing from 4 to 20 carbon atoms, or is a group of the formula $-(R^4O)_nR^5$ wherein each $R^4$ is the same or different and each is an alkylene group, preferably ethylene, propylene or butylene, $R^5$ is an alkyl group, preferably containing from 1 to 18, more preferably 1 to 4, carbon atoms, or an aryl group, and n is an integer, preferably of from 1 to 10, more preferably of from 2 to 4;

or (ii) $R^1$ and $R^2$ are the same or different and as defined above and $R^3$ is a group of the general formula:

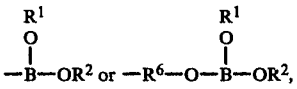

wherein $R^1$ and $R^2$ are as defined above and $R^6$ is an alkylene group, preferably containing at least 4, more preferably from 4 to 20, carbon atoms, or is an oxyalkylene radical of the formula $-R^4(OR^4)_n$ wherein $R^4$ and n are as defined above;

or (iii) $R^1$ is as defined above and $R^2$ and $R^3$ together form the group

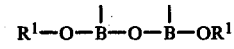

wherein $R^1$ is as defined above;

(c) an amine which prevents deposition of oil-insoluble hydrolysis products of the borate ester; and optionally (d) an oil soluble orthoester of the formula:

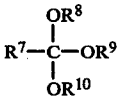

wherein $R^7$ is hydrogen or an alkyl group, preferably methyl or an aryl, alkaryl, or aralkyl group; $R^8$, $R^9$ and $R^{10}$ are the same or different, preferably the same, and each is a straight or branched chain alkyl group, preferably containing from 4 to 20 carbon atoms, an aryl, alkaryl, or aralkyl group, or the group $-(R^{11}-O)_mR^{12}$ wherein each $R^{11}$ is the same or different and each is an alkylene group, preferably ethylene or propylene; $R^{12}$ is an alkyl group, preferably containing from 1 to 20 carbon atoms, or an aryl, alkaryl or aralkyl group; and m is an integer of from 2 to 10.

It is required that the borate ester used in the composition of the invention should be oil-soluble and, in the case of trialkyl borates, oil solubility may be provided by selecting an ester made from straight chain alcohols containing less than 12 carbon atoms or from branched chain alcohols containing up to 24 carbon atoms. In the case of borate esters of the type derived from di- and polyoxyalkylene glycol ethers, those derived from di- and polyoxyethylene glycol ethers are generally insoluble unless at least one of the terminal ether groups is sufficient to solubilise the ester. Alternatively oil-solubility for this latter type of ester may be achieved by incorporating polyoxypropylene or higher polyoxyalkylene radicals into the molecule.

Examples of particularly useful borate esters include
tris (dipropylene glycol monomethyl ether) borate
tris (ethylene glycol monobutyl ether) borate
tris (triethylene glycol monobutyl ether) borate
tris (tripropylene glycol monomethyl ether) borate
tri n-decyl borate
tri (isotridecyl) borate
tri (2-ethyl hexyl) borate
tri (3,3-dimethyl butyl) borate The amine used in the present invention should have a reasonably low vapour pressure consistent with providing a vapour lock temperature in excess of 120° C. The amine used will also depend upon the borate ester used. A simple test for determining whether a particular amine is suitable for preventing deposition of oil-insoluble hydrolysis products of a particular borate ester consists of dissolving the amine and borate in the selected lubricating oil, (in the amounts intended in the final hydraulic fluid), sealing the resulting fluid together with 0.5% by weight of water in a clear glass ampoule and heating at 100° C. for 24 hours and cooling. In this so called "ampoule" test, if the resulting solution is clear and bright then the combination is satisfactory.

Many amines have been found to be suitable, including primary, secondary and tertiary amines, especially those containing a total of at least 5 carbon atoms. Amines which have been found to be particularly useful with a wide range of borates include Primene 81 R and Primene JMT which are commercially available primary amines with two methyl groups on the alpha carbon atom.

Other amines which may be useful are Mannich bases formed by condensation of an amine and formaldehyde with a phenol previously alkylated with di or polyisobutylene; polyisobutenyl succinimides derived from di or polyamines; or amides derived from di or polyalkyl polyamines and polyisbutenyl substituted monocarboxylic acids.

The amounts of components (b), (c) and (d) (when present) may each vary over a wide range. However, it is preferred to use from 1 to 50%, more preferably from 1 to 20%, particularly from 5 to 10% by weight of the borate ester; from 1 to 50%, more preferably from 5 to 30%, particularly from 10 to 20% by weight of the orthoester; and from 0.5 to 20%, more particularly from 1 to 10%, by weight of amine, the percentages being based on the total weight of the composition.

In compositions containing orthoester, the ratio of orthoester to borate may vary, for example, from 10:1 to 1:10 by weight but in general more orthoester than borate will be used, the preferred ratio varying from 5:1 to 2:1 by weight.

The ratio of borate to amine will depend upon the nature of the two particular compounds used but it is preferred to use from 5:1 to 1:1 by weight.

The lubricating oil used as base fluid in the compositions of the invention is preferably a mineral oil but may also be a synthetic hydrocarbon oil, a synthetic carboxylic acid ester or mixture thereof, a siloxane or phosphate ester or other well known synthetic lubricant.

The invention will now be illustrated by the following Examples:

Example 1

| | |
|---|---|
| Mineral oil blend | 85% |
| Tris(tripropylene glycol monomethyl ether)borate | 10% |
| tridecyl borate | 3% |
| Primene JMT | 2% |

This composition has the following physical characteristics: Boiling point 257° C., Viscosity at −40° C. 1328cS, Viscosity index 218. The composition was subjected to the Markey vapour-lock test in the dry state and after contamination with varying amounts of water, with the following results:

| Water present (wt. %) | dry | 0.2% | 0.5% | 0.75% |
|---|---|---|---|---|
| Vapour lock temperature (°C.) | 253 | 238 | 178 | 140 |

The mineral oil alone with 0.5% water had a vapour lock temperature of 101° C.

Examples 2 to 32

Further blends comprising various combinations of borate ester and amine in mineral oil were formulated and subjected to the Gilpin vapour-lock test. Details of these blends and of the results obtained are given in Table 1.

The base fluid used in each case was a naphthenic mineral oil having the following characteristics:

| | |
|---|---|
| Viscosity | 130cS at −40° C., 3.5cS at 100° F. and 1.31cS at 210° F. |
| Pour point | <−70° F. |
| Boiling Point | 248° C. |
| Flash Point (closed) | 208° C. |
| Aniline Point | 76° C. |

The Gilpin vapour-lock test was conducted in a Gilpin apparatus and by the Gilpin method as described in S.A.E. Paper 710 253 entitled "Operating performance of motor vehicle braking systems as affected by fluid water content." The Gilpin vapour-lock temperature (VLT) was taken to be the temperature which corresponded with the appearance of 3 ml of bubbles.

Examples 33 to 47

Gilpin vapour lock temperatures were evaluated (in the manner described above) for a range of compositions containing different combinations of borate ester and lubricating oil base fluid, Primene JMT being used as the amine component in each case. Details of these compositions and of the results obtained are given in Table 2.

Example 48

| | |
|---|---|
| Tris - (tridecyl)orthoformate | 10% |
| Tris(dipropylene glycol monomethyl-ether)borate | 10% |
| Primene JMT | 5% |
| Mineral Oil | 75% |

This blend conformed with the base oil requirements of Specification DTD 585. The Gilpin vapour-lock temperature was 177° C. after heating at 100° C. for 24 hours with 0.5% water in a sealed glass ampoule.

Example 49

| | |
|---|---|
| Tris(tridecyl)orthoformate | 20% |
| Tris(dipropylene glycol monomethyl ether)borate | 5% |
| Primene JMT | 5% |
| Mineral Oil | 70% |

This blend also conformed to the base oil requirements to DTD 585 Specification and the Gilpin (3 ml) wet vapour-lock temperature was 203° C.

Example 50

| | |
|---|---|
| Tris(tridecyl)orthoformate | 20% |
| Tris(dipropylene glycol monomethyl) borate | 5% |
| Primene JMT | 3% |
| Mineral Oil | 72% |

This blend also conformed to the base oil requirements of the DTD 585 Specification and the Gilpin (3 ml) wet vapour-lock temperature was 206° C.

Example 51

| | |
|---|---|
| Tris(tridecyl)orthoformate | 20% |
| Tris(dipropylene glycol monomethyl | 5% |

-continued

| | |
|---|---|
| ether)borate | |
| Tris(tridecyl)borate | 2% |
| Primene JMT | 3% |
| Mineral Oil | 70% |

This blend conformed to the base oil requirements of the DTD 858 Specification and has a Gilpin (3 ml) wet vapour-lock temperature of 205.5° C.

Examples 52 to 81

Further blends containing orthoester were formulated from a range of different orthoesters and borate esters. In each case Primene JMT was used as the amine component and the base fluid was the naphthenic mineral oil used in Examples 2 to 32. Samples of these blends were subjected to the Gilpin (3 ml) vapour-lock test (i) after reaction with 0.5% water at 100° C. for 24 hours and (ii) after subjection to a humidity test at a Relative Humidity (RH) of 80% and temperature of 22° C. substantially as described in the FMVSS 113 Specification but extended to a 5 day period and without a reference fluid. Also, the Rubber Swell properties of the test fluids with respect to nitrile rubber were determined by measuring the increase in volume of a 2.54 cm square, 2 mm thick nitrile rubber specimen in 50 mls of fluid at 120° C. for 3 days.

Details of these blends and of the results obtained are given in Table 3.

The abbreviations and commercial products referred to in Tables 1 to 3 are as follows:

| | |
|---|---|
| DPM | dipropylene glycol monomethyl ether |
| TPM | tripropylene glycol monomethyl ether |
| PPG | polypropylene glycol |
| Primene 81 R and Primene JMT | commercially available primary amines with two methyl groups on the alpha carbon atom |

-continued

| | |
|---|---|
| Lubrizol 894 and Hitec E 638 (Edwin Cooper) | commercially available polyisobutenyl succinimides of polyalkylene polyamines. |
| Empilan KS 3 | commercially available mixture of triethyleneglycol mono ethers of $C_9$ to $C_{11}$ alcohols. |
| Empilan KB 2 | commerciall available mixture of diethylene glycol mono ethers of $C_{12}$ to $C_{14}$ alcohols. |
| Burning Oil | a paraffinic heavy kerosene having a flash point of 260° F., a specific gravity of 0.82 and viscosities at 100° F. and 210° F. of 4.5cS and 1.6cS respectively. |
| Refrigerant Oil A | a blend of naphthenic mineral oils having a specific gravity of 0.892, viscosity at 100° F. of 48cS, flash point of 360° F. and a pour point of −30° F. |
| Refrigerant Oil B | a blend of naphthenic mineral oils having a specific gravity of 0.983, flash point of 330° F. pour point of −30° F. and viscosities at 100° F. and 210° F. of 53.4cS and 5.36cS respectively. |
| Refrigerant Oil C | a commercially available refrigerant oil manufactured by British Petroleum under the trademark ZERICE 353 and believed to be a mixture of alkylated benzenes. |
| Silicone Fluid | an experimental silicone brake fluid supplied by Union Carbide Corporation. |

The vapour-lock test results set out in the foregoing Examples and in Tables 1 to 3 show that fluids in accordance with the invention retain unexpectedly high vapour-lock temperatures even in the presence of water. Furthermore, the rubber swell test results set out in Table 3 show that fluids in accordance with the invention may be blended so as to provide fluids having rubber swell properties acceptable in commercial hydraulic systems.

TABLE I

| Example No | BORATE ESTER | wt. % | AMINE | wt. % | GILPIN VLT (°C.) |
|---|---|---|---|---|---|
| 2 | TETRA(DPM)PYROBORATE | 10 | PRIMENE 81 R | 2 | 181 |
| 3 | TETRA(TPM)PYROBORATE | 10 | LUBRIZOL 894 | 20 | 178 |
| 4 | TRIS n-BUTYL BORATE | 15 | 2-ETHYL HEXYLAMINE | 2 | 133 |
| 5 | TETRA(PENT 2YL) PYROBORATE | 10 | PRIMENE JMT | 5 | 170 |
| 6 | TRIS(DPM)METABORATE | 10 | PRIMENE 81R | 10 | 186 |
| 7 | TRIS(n-OCTYL) METABORATE | 10 | PRIMENE JMT | 10 | 155 |
| 8 | TRIS(BUTYL MONOGLYCOL) METABORATE | 10 | PRIMENE JMT | 5 | 167 |
| 9 | TRIHEXYLENE GLYCOL BISBORATE | 10 | PRIMENE JMT | 2 | 143 |
| 10 | TRIS(OLEYL)BORATE | 15 | PRIMENE JMT | 10 | 120 |
| 11 | TRIS(m-TOLYL)BORATE | 10 | PRIMENE JMT | 2 | 222 |
| 12 | TRIS(p-TOLYL)BORATE | 10 | PRIMENE JMT | 2 | 205 |
| 13 | TRIS(o-TOLYL)BORATE | 10 | PRIMENE JMT | 2 | 206 |
| 14 | TRIS(p-tert.BUTYL PHENYL)BORATE | 10 | PRIMENE JMT | 10 | 177 |
| 15 | TRIS(BENZYL)BORATE | 10 | PRIMENE JMT | 5 | 151 |
| 16 | TRIS(n-OCTYL)BORATE | 15 | DIHEXYLAMINE | 2 | 139 |
| 17 | TRIS(PENT 2YL) BORATE | 15 | PRIMENE 81R | 5 | 144 |
| 18 | TRIS(2 NAPHTHYL) BORATE | 10 | PRIMENE JMT | 10 | 218 |
| 19 | HEXYLENE GLYCOL BIS DPM BIS BORATE | 10 | PRIMENE JMT | 2 | 167 |
| 20 | PPG 1200 BIS ISO-TRIDECYL BIS BORATE | 15 | PRIMENE JMT | 10 | 138 |

TABLE I-continued

| Example No | BORATE ESTER | wt. % | AMINE | wt. % | GILPIN VLT (°C.) |
|---|---|---|---|---|---|
| 21 | TRIS(OCT 2YL)BORATE | 15 | PRIMENE JMT | 7 | 179 |
| 22 | TRIS(ISODECYL)BORATE | 15 | PRIMENE JMT | 10 | 135 |
| 23 | TRIS(ISOTRIDECYL) BORATE | 15 | PRIMENE JMT | 10 | 131 |
| 24 | TRIS(ISO-OCTADECYL) BORATE | 20 | PRIMENE JMT | 20 | 126 |
| 25 | TRIS(3 METHYL 1 BUTYL)BORATE | 15 | TRIOCTYLAMINE | 20 | 154 |
| 26 | TRIS(3 METHYL PENT 3YL)BORATE | 15 | PRIMENE JMT | 5 | 171 |
| 27 | TRIS(2 METHYL CYCLOHEXYL)BORATE | 15 | PRIMENE JMT | 5 | 171 |
| 28 | TRIS(BUTYL MONO-GLYCOL)BORATE | 15 | DIALLYLAMINE | 5 | 169 |
| 29 | TRIS(BUTYL TRIGLYCOL) BORATE | 15 | n-HEXYLAMINE | 2 | 184 |
| 30 | TRIS(HEXYL-DIGLYCOL) | 15 | PRIMENE 81R | 2 | 145 |
| 31 | TRIS(DPM)BORATE | 10 | HITEC E 638 | 20 | 186 |
| 32 | TRIS(TPM)BORATE | 10 | PRIMENE JMT | 10 | 181 |

TABLE 2

| Example No | BORATE ESTER | wt % | PRIMENE JMT (wt %) | BASE FLUID | GILPIN VLT (°C.) |
|---|---|---|---|---|---|
| 33 | TRIS(n-BUTYL)BORATE | 15 | 5 | BURNING OIL | 142 |
| 34 | TRIS HEXYLENE GLYCOL BIS BORATE | 10 | 5 | BURNING OIL | 157 |
| 35 | TRIS (BUTOXYETHOXY PROPYL)BORATE | 15 | 5 | BURNING OIL | 166 |
| 36 | TRIS(2 METHYL CYCLO-HEXYL)BORATE | 15 | 5 | DI(ISO-OCTYL) ADIPATE | 220 |
| 37 | TRIS(BUTYL MONO GLYCOL)BORATE | 15 | 2 | REFRIGERANT OIL A | 185 |
| 38 | TRIS(3 METHYL 1 BUTYL)BORATE | 15 | 5 | REFRIGERANT OIL B | 153 |
| 39 | TRIS(o-BUTYL) BORATE/TRIS(O-TOLYL) BORATE | 15 | 5 | REFRIGERANT OIL C | 236 |
| 40 | TRIS(n-BUTYL)BORATE | 15 | 5 | SILICONE FLUID | 133 |
| 41 | TRIS(BUTYL MONO-GLYCOL)BORATE | 15 | 5 | SILICONE FLUID | 188 |
| 42 | TRIS(3 METHYL 1 BUTYL) BORATE | 15 | 5 | PENTAERYTHRITOL-HEPTANOATE | 180 |
| 43 | TRIS(o-TOLYL)BORATE | 10 | 5 | TRIMETHYLOL PROPANE | 256 |
| 44 | TRIS(BUTYL TRIGLYCOL) BORATE | 15 | 5 | DI (TRIDECYL) DODECANE DIOATE | 223 |
| 45 | TRIS(DPM)BORATE | 10 | 5 | DI(2-ETHYLHEXYL) DODECANE DIOATE | 218 |
| 46 | TRIS(PHENYL GLYCOL ETHER) BORATE | 10 | 2 | TRIBUTYL PHOSPHATE | 205 |
| 47 | TRIS(EMPILAN KS 3) BORATE | 10 | 2 | TRI BUTYL PHOSPHATE | 195 |

TABLE 3

| Example No | ORTHOESTER Name | wt % | BORATE ESTER NAME | wt % |
|---|---|---|---|---|
| 52 | TRIS(BUTYL)ORTHOFORMATE | 25 | TRIS(n-DECYL)ORTHOBORATE | 12 |
| 53 | TRIS(BUTYL)ORTHOFORMATE | 15 | TRIS(n-OCTYL)ORTHOBORATE | 5 |
| 54 | TRIS(2 ETHYL HEXYL) ORTHOFORMATE | 28 | TRIS(n-BUTYL)ORTHOBORATE | 7 |
| 55 | TRIS(2 ETHYL HEXYL) ORTHOFORMATE | 25 | TRIS(TRIDECYL)ORTHOBORATE | 20 |
| 56 | TRIS(BUTYL TRIGLYCOL) ORTHOFORMATE | 30 | TRIS(ISO DECYL)ORTHOBORATE | 11 |
| 57 | TRIS(DOWANOL DPM) ORTHOFORMATE | 15 | TRIS(METHYL BUTYL) ORTHOBORATE | 13 |
| 58 | TRIS(TRIDECYL) ORTHOFORMATE | 30 | TRIS(PENT-2-YL) ORTHOBORATE | 15 |
| 59 | TRIS(TRIDECYL) ORTHOACETATE | 15 | TRIS(2-OCTYL)ORTHOBORATE | 13 |
| 60 | TRIS(TRIDECYL) ORTHOFORMATE | 25 | TRIS(OLEYL)ORTHOBORATE | 15 |

TABLE 3-continued

| | | | | |
|---|---|---|---|---|
| 61 | TRIS(OLEYL) ORTHOFORMATE | 15 | TRIS(p-TOLYL)ORTHOBORATE | 3 |
| 62 | TRIS(DPM)ORTHOACETATE | 10 | TRIS(BUTYL MONOGLYCOL) | 6 |
| 63 | TRIS(BUTYL TRIGLYCOL) ORTHOFORMATE | 30 | TRIS(BUTYL TRIGLYCOL) ORTHOBORATE | 17 |
| 64 | TRIS(DPM)ORTHOFORMATE | 15 | TRIS(HEXYL DIGLYCOL) ORTHOBORATE | 4 |
| 65 | TRIS(OLEYL)ORTHOFORMATE | 20 | TRIS(DPM)ORTHOBORATE | 5 |
| 66 | TRIS(BENZYL)ORTHOFORMATE | 20 | TRIS(BUTYL MONOGLYCOL) ORTHOBORATE | 5 |
| 67 | TRIS(ISO OCTADECYL) ORTHOFORMATE | 25 | TETRA(TPM)PYBORATE | 4 |
| 68 | TRIS(DPM)ORTHOACETATE | 17 | TRIS(DPM)METABORATE | 4 |
| 69 | TRIS(ALLYL)ORTHOFORMATE | 19 | TRIS(BENZYL)ORTHOBORATE | 7 |
| 70 | TRIS(BUTYL MONOGLYCOL) ORTHOACETATE | 25 | TRIS(METHYL CYCLOHEXYL) ORTHOBORATE | 10 |
| 71 | TRIS(TRIDECYL)ORTHO-FORMATE | 15 | TRIS(TPM)ORTHOBORATE | 2 |
| 72 | TRIS(BUTYL MONOGLYCOL) ORTHOACETATE | 30 | TETRA(DPM)PYROBORATE | 3 |
| 73 | TRIS(ISO OCTADECYL) ORTHOFORMATE | 27 | HEXAMETHYLENE GLYCOL BIS DPM. BIS BORATE | 9 |
| 74 | TRIS(2 ETHYL HEXYL) ORTHOFORMATE | 22 | TETRA(BUTYL MONOGLYCOL) PYROBORATE | 5 |
| 75 | TRIS(EMPILAN KB2) ORTHOFORMATE | 14 | TRIS(EMPILAN KB2) ORTHOBORATE | 5 |
| 76 | TRIS(DPM)ORTHOACETATE | 23 | TRIS(ISOOCTADECYL) ORTHOBORATE | 6 |
| 77 | TRIS(BUTYL MONOGLYCOL) ORTHOACETATE | 21 | TRIS(p-tert.BUTYL PHENYL)ORTHOBORATE | 8 |
| 78 | TRIS(BUTYL TRIGLYCOL) ORTHOFORMATE | 24 | TRIS(2 NAPHTHYL) ORTHOBORATE | 9 |
| 79 | TRIS(DPM)ORTHOFORMATE | 14 | PPG 1200 BIS TRIDECYL BIS BORATE | 3 |
| 80 | TRIS(3 METHYL PENTYL) ORTHOFORMATE | 15 | TRIS(TPM)ORTHOBORATE | 4 |
| 81 | TRIS(TRIDECYL)ORTHO-VALERATE | 15 | TRIS(DPM)ORTHOBORATE | 2 |

| Example | AMINE | | NITRILE RUBBER VOLUME SWELL (%) | GILPIN VLT AFTER REACTION WITH 0.5% WATER | GILPIN VLT AFTER 5 DAY HUMIDITY TEST 80% RH 22° C. |
|---|---|---|---|---|---|
| No | NAME | wt % | (3 days at 120° C.) | (°C.) | (°C.) |
| 52 | PRIMENE JMT | 5 | 1.55 | 144 | 128 |
| 53 | PRIMENE JMT | 6 | 3.5 | 134 | 148 |
| 54 | PRIMENE 81R | 2 | 0.7 | 161 | 154 |
| 55 | PRIMENE JMT | 10 | 0.9 | 198 | 203 |
| 56 | PRIMENE JMT | 10 | 12.4 | 195 | 138 |
| 57 | PRIMENE JMT | 10 | 5.1 | 172 | 130 |
| 58 | PRIMENE JMT | 12 | −1.6 | 164 | 120 |
| 59 | PRIMENE JMT | 8 | 3.4 | 184 | 115 |
| 60 | PRIMENE JMT | 10 | 3.5 | 185 | 133 |
| 61 | PRIMENE JMT | 3 | 11.3 | — | 221 |
| 62 | PRIMENE JMT | 2 | 6.1 | 152 | 120 |
| 63 | PRIMENE 81R | 3 | 19.8 | 168 | 137 |
| 64 | PRIMENE UMT | 1 | 8.8 | 174 | 211 |
| 65 | PRIMENE JMT | 3 | 2.5 | 129 | 156 |
| 66 | PRIMENE JMT | 5 | 32.9 | 199 | 196 |
| 67 | PRIMENE JMT | 2 | −0.2 | 154 | 249 |
| 68 | PRIMENE JMT | 10 | 13.3 | 171 | 175 |
| 69 | PRIMENE JMT | 4 | 17.1 | 120 | 110 |
| 70 | PRIMENE JMT | 5 | 7.8 | 193 | 155 |
| 71 | PRIMENE JMT | 2 | 0.3 | 147 | 242 |
| 72 | PRIMENE JMT | 6 | 9.7 | 197 | 202 |
| 73 | PRIMENE JMT | 2 | 0.2 | 214 | 218 |
| 74 | PRIMENE JMT | 5 | 4.5 | 178 | 144 |
| 75 | PRIMENE JMT | 3 | 2.9 | 126 | 133 |
| 76 | PRIMENE JMT | 3 | 8.0 | 179 | 207 |
| 77 | PRIMENE JMT | 8 | 23.1 | 205 | 149 |
| 78 | PRIMENE JMT | 9 | 35.6 | 204 | 172 |
| 79 | PRIMENE JMT | 5 | 6.0 | 166 | 212 |
| 80 | PRIMENE JMT | 3 | 11.3 | 112.5 | 123 |
| 81 | PRIMENE JMT | 2 | 1.9 | 127* | 149 |

*With 0.25% Water

We claim:

1. A composition of matter suitable for use as a hydraulic fluid which comprises (a) at least 20%, by weight, of a lubricating oil which is a member selected from the group consisting of a mineral oil, a synthetic hydrocarbon oil, a synthetic carboxylic acid ester, a siloxane or a phosphate ester;

(b) 1 to 50%, by weight, of oil-soluble borate ester which is a compound, or mixture of compounds, having the formula:

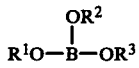

wherein:

(i) $R^1$, $R^2$ and $R^3$ are the same or different and each is an aryl group or a straight or branched chain alkyl group or alicyclic group containing from 4 to 20 carbon atoms, or is a group of the formula $-R^4O)_nR^5$ wherein each $R^4$ is the same or different and each is an alkylene group selected from ethylene, propylene or butylene, $R^5$ is an alkyl group containing from 1 to 18 carbon atoms, or an aryl group, and n is an integer, from 1 to 10; or (ii) $R^1$ and $R^2$ are the same or different and as defined above and $R^3$ is a group of the general formula:

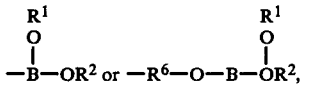

wherein $R^1$ and $R^2$ are as defined above and $R^6$ is an alkylene group containing from 4 to 20 carbon atoms, or is an oxyalkylene radical of the formula $-R^4-OR^4)_n$ wherein $R^4$ and n are as defined above; or (iii) $R^1$ is as defined above and $R^2$ and $R^3$ together form the group

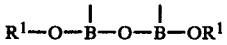

wherein $R_1$ is as defined above;

(c) 0.5 to 20%, by weight, of an amine which prevents deposition of oil insoluble hydrolysis products of the borate ester; and (d) 1 to 50%, by weight, of an oil soluble orthoester of the formula:

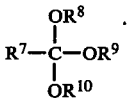

wherein $R^7$ is hydrogen or lower alkyl; $R^8$, $R^9$ and $R^{10}$ are the same or different and each is a straight or branched chain alkyl containing from 4 to 20 carbon atoms, benzyl or the group $-(R^{11}-O)_m-R^{12}$ where $R^{11}$ is a lower alkylene group and $R^{12}$ is an alkyl group containing 1 to 20 carbon atoms; and m is an integer from 2 to 10.

2. A composition as claimed in claim 1 wherein $R^7$ is a hydrogen atom or a methyl group.

3. A composition as claimed in claim 1 which contains from 5 to 30% by weight of orthoester based on the total weight of the composition.

4. A composition as claimed in claim 1 wherein the ratio of orthoester to borate ester is in the range from 5:1 to 2:1 by weight.

5. A composition as claimed in claim 1 containing from 1 to 20% by weight of borate ester based on the total weight of the composition.

6. A composition as claimed in claim 1 containing from 1 to 10% by weight of amine based on the total weight of the composition.

7. A composition as claimed in claim 1 wherein the ratio of borate ester to amine is from 5:1 to 1:1 by weight.

* * * * *